United States Patent [19]

Cote, Jr.

[11] Patent Number: 4,833,716

[45] Date of Patent: May 23, 1989

[54] SPEECH WAVEFORM ANALYZER AND A METHOD TO DISPLAY PHONEME INFORMATION

[75] Inventor: Alfred J. Cote, Jr., Clarksville, Md.

[73] Assignee: The John Hopkins University, Baltimore, Md.

[21] Appl. No.: 665,204

[22] Filed: Oct. 26, 1984

[51] Int. Cl.[4] ..... G10L 7/10

[52] U.S. Cl. ..... 381/48

[58] Field of Search ..... 381/41-50; 364/522, 513.5; 434/185

[56] References Cited

U.S. PATENT DOCUMENTS

| | | | |
|---|---|---|---|
| 3,499,989 | 3/1970 | Cotterman et al. | 381/50 |
| 3,881,059 | 4/1975 | Stewart | 434/185 |
| 4,038,503 | 7/1977 | Moshier | 381/50 |
| 4,039,754 | 8/1977 | Lokerson | 381/50 |
| 4,063,035 | 12/1977 | Appelman et al. | 381/48 |
| 4,127,849 | 11/1978 | Okor | 364/522 |
| 4,378,466 | 3/1983 | Esser | 381/48 |
| 4,401,851 | 8/1983 | Nitta et al. | 381/45 |
| 4,492,917 | 1/1985 | Inami et al. | 381/48 |
| 4,520,501 | 5/1985 | Dubrucq | 381/48 |
| 4,627,092 | 12/1986 | Nen | 381/48 |
| 4,641,343 | 2/1987 | Holland et al. | 381/48 |

OTHER PUBLICATIONS

Flanagan, *Speech Analysis Synthesis and Perception*, 1972, pp. 150-155, 165-170, Springer-Verlag.

Central Institute for the Deaf, "Progress Report No. 25", 7/1/81-6/30/82.

*Primary Examiner*—Gary V. Harkcom

*Assistant Examiner*—John A. Merecki

*Attorney, Agent, or Firm*—Robert E. Archibald; Francis A. Cooch

[57] ABSTRACT

A speech analyzer which displays a three dimensional spectral vector representing a phoneme on a two-dimensional screen utilizes an algorithm which generates and displays a triangle representative of a three-dimensional coordinate system. The three-dimensional spectral vector is transformed into a point which is displayed inside the triangle.

23 Claims, 3 Drawing Sheets

SPEECH WAVEFORM ANALYZER AND A METHOD TO DISPLAY PHONEME INFORMATION

BACKGROUND OF THE INVENTION

The invention concerns the generation of speech images, wherein the sounds of phonemes are plotted with the aid of a speech input card and associated software. The invention has particular application as a speech training aid for the deaf; as a tool in the study of languages of other species (e.g., porpoises); as a preprocessing transformation in auditory prostheses; and a phoneme perception mechanism in speech recognition systems.

Numerous devices have been proposed for displaying and analyzing speech signals with the intent of interpreting the speech as a string of symbols corresponding to the distinctive speech sounds of the language (the phonemes) that conveys the spoken message. With such devices, accurate phoneme recognition falls in the 50–80% range. Human listeners typically achieve 90% accurcy in phoneme recognition.

A first type of prior art device utilizes zero crossing detectors for determining when a speech waveform crosses a predetermined amplitude. Zero crossing detectors have a tendency to respond only to a frequecy component having the highest amplitude. Thus, important information contained in frequency components having lower amplitudes than the peak component are ignored, resulting in a substantial loss of information. Accordingly, zero crossing detectors are not well suited for analyzing the speech waveforms of speakers having widely differing glottal or fundamental frequencies, as exist between men, women, and children.

A second sort of speech analyzer utilizes a bank of parallel bandpass filters, each filter providing a relatively narrow bandpass to an associated amplitude detector. A DC signal is derived which indicates the phoneme amplitude, however, in parallel bandpass filters analyzers the amount of information derived is often so great that difficulties arise in coding the resultant phoneme.

A third type of known speech analyzer is capable of learning the characteristics of different speakers as taught by Moshier in U.S. Pat. No. 4,227,177. Such systems, however, are not usually adaptable for analyzing the speech of a wide variety of speakers whose patterns have not yet been programmed in the analyzer's memory.

U.S. Pat. No. 4,401,851 to Nitta et al teaches a speech recognition circuit, wherein a vowel segment is determined according to the acoustic power spectrum data and a vowel and consonant are recognized according to the respective acoustic power spectrum data in the vowel segment and outside the vowel segment. Lokerson's U.S. Pat. No. 4,039,754 discloses a speech analyzer for accurately indicating the phoneme utterances of speakers having widely varying speech characteristics. The phoneme utterance is divided into three formants, wherein the frequency content of one formant is normalized against another. A first and third formant are normalized relative to a second formant frequency, by taking the ratio of the first to second formants and third the to second formants, such that compensation is provided for the shift in fundamental frequencies of different speakers.

SUMMARY AND OBJECTS OF THE INVENTION

Each utterance or phoneme, is divided into four frequency bands; voicing, low, medium and high. The resultant information is processed such that the voicing band is used to recognize the occurrence of a vowel. Additionally, the low, medium and high bands are normalized and ranked relative to one another, forming the coordinates of a vector extending from an origin of a three-coordinate ranking diagram. A plane which intersects each axis of the coordinate system at one (1) is used to generate a display for identifying a spoken phoneme. The relative location of the point at which the vector pierces the plane identifies the specific spoken phoneme to the viewer of the display.

It is the object of the present invention to provide a speech analyzing device wherein a phoneme is represented by the relative amplitudes of a three-dimensional co-ordinate system with a vector.

Another object of the invention is to generate a display which accurately represents the phoneme.

DETAILED DESCRIPTION OF THE INVENTION

The data is supplied through an input/output (I/O) channel to a computer 30 which, through a software program 62, supplies information to a display device 31.

DEAILED DESCRIPTION OF THE INVENTION

Figure 1:
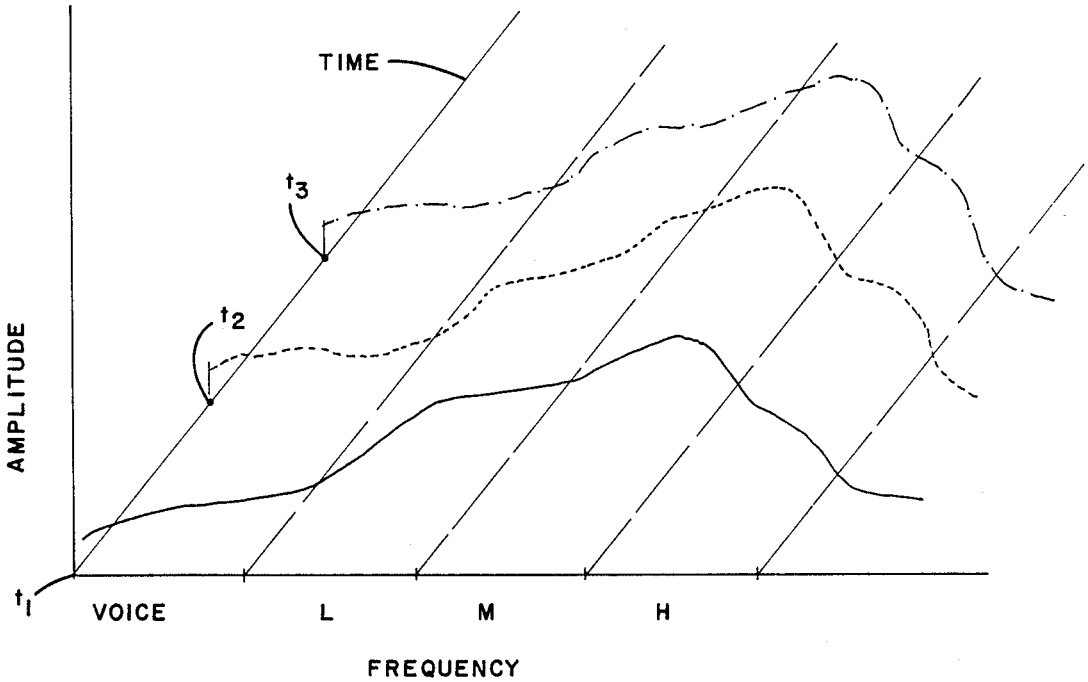
FIG. 1 is a graph depicting a phoneme as a function of frequency, amplitude and time.

The running spectrum for speech is typically of the form shown in FIG. 1. According to the present invention, the relative amplitudes of the energy in three broad subregions within this spectrum, over any brief span of time (t1, t2, t3) provide a basis for identifying and plotting the phoneme sound of the language being uttered at that point in time. For example, one set of three regions useful in the recognition of vowels are designated: Low (235–940 Hz), Mid (940–1537), and High (1537–4108). A set useful in recognizing consonants is Voicing (below 235 Hz), plus the same Mid and High regions.

Figure 2:
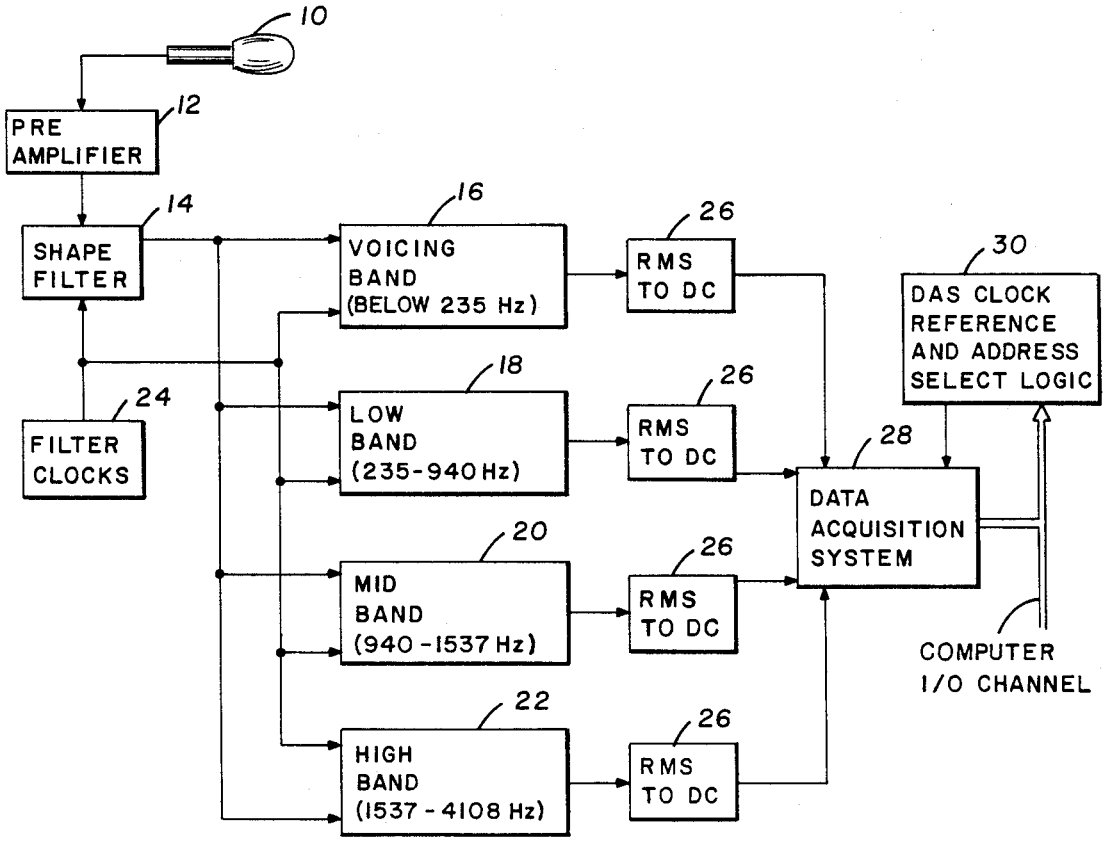
FIG. 2 is a schematic of a speech-input card.

One embodiment of the invention is a small computer equipped with a means of implementing this process. Thus FIG. 2 shows a speech input card to such a computer. A microphone 10 drives a two-stage preamplifier 12 whose high-frequency roll-off starts at about 6 KHz and serves an anti-aliasing role for the following switched-capacitor filters. A shape filter 14 approximates the broad spectral sensitivity of the ear's cochlea and enhances the discriminatory power of the phoneme recognition method. A low pass voicing band filter 16 with a 235 Hz corner serves as voicing channel. Three bandpass filters 18, 20, 22 respectively yield low, mid, and high frequency channels. The low band filter 18 is provided with corners of 235 and 940 Hz. The mid band filter 20 has corners at 940 and 1537 Hz. Corners of 1537 and 4108 Hz are provided for the high bandpass filter 22. A clock 24 is provided for operation of the switched-capacitor filters.

To translate the filter band outputs to DC levels, RMS to DC converters 26 are utilized. Outputs from the RMS to DC converters 26 are fed to a data acquisition system 28. The data acquisition system 28 comprises a monolithic 8 bit, 8-channel, memory-buffered data-acquisition system. The data acquisition system 28 sequentially converts each of its inputs into a digital byte, storing the results in a 8×8-dual-port RAM. A clock 29 is provided to gate the data into the data acquisition system 28. The scan period of the clock 30 is approximately 0.67 millisec. Data which is generated from the data acquisition system 28 is independent of the scanning/conversion, and interleaving of the memory update. Readout of the data is automatically managed by on-chip logic. FIG. 5 is a flowchart of the software program to generate the display of FIG. 4.

Figure 3:
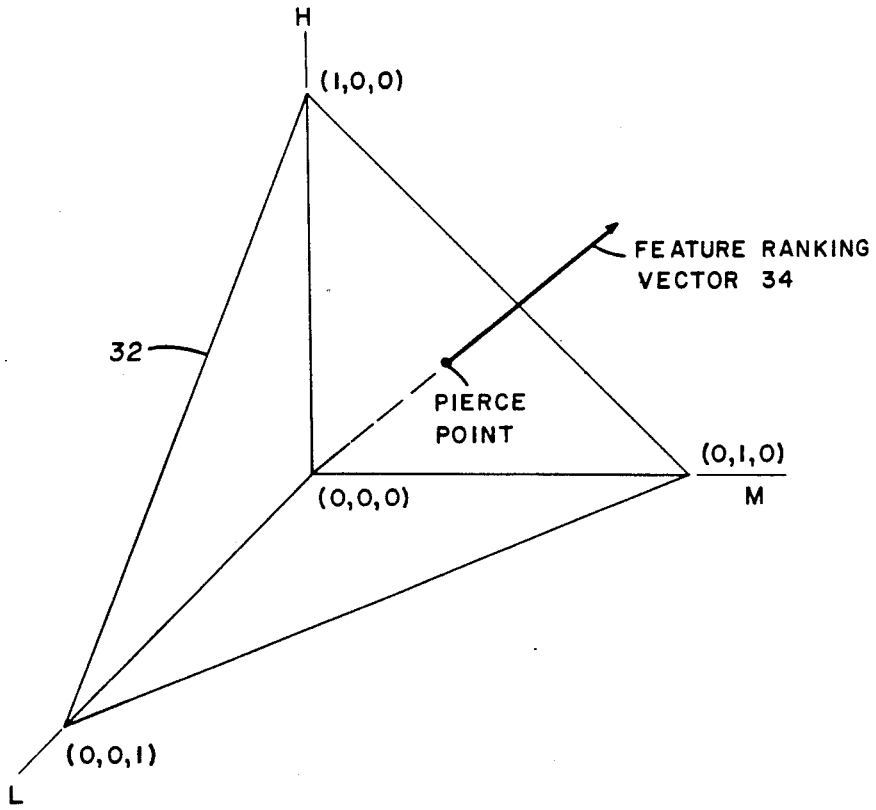
FIG. 3 shows a three-coordinate ranking diagram.

FIG. 3 reveals a 3-dimensional view of a ranking diagram on which the display of the present invention is based. A 3-coordinate (L, M, H) system is shown wherein a plane intersects each axis of the coordinate system at 1. The resultant intersection of this plane with the three planes defined by the coordinate system axes results in a triangular plane 32. The outputs of low band, mid band and high band ranges are normalized about the occurring peak amplitude. In the case of the FIG. 1 example, the low band and high bands are normalized about the mid band. These resultant normalized variables comprise the components of a ranking vector 34, with its origin at the point (0,0,0) of the tri-coordinate system. This vector pierces the triangular plane 32. The location of this pierce point number serves to identify the phoneme. Since such a three-dimensional display may be confusing to some viewers, the tri-coordinate system and ranking vector 34 are transformed to be displayed in two dimensions.

Figure 4:
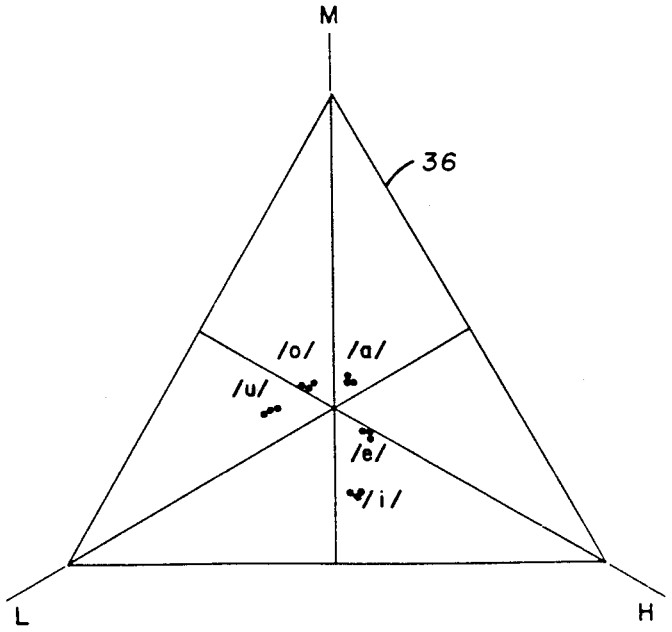
FIG. 4 shows the ranking diagram of FIG. 3 transformed into a two-coordinate system.
Figure 5:
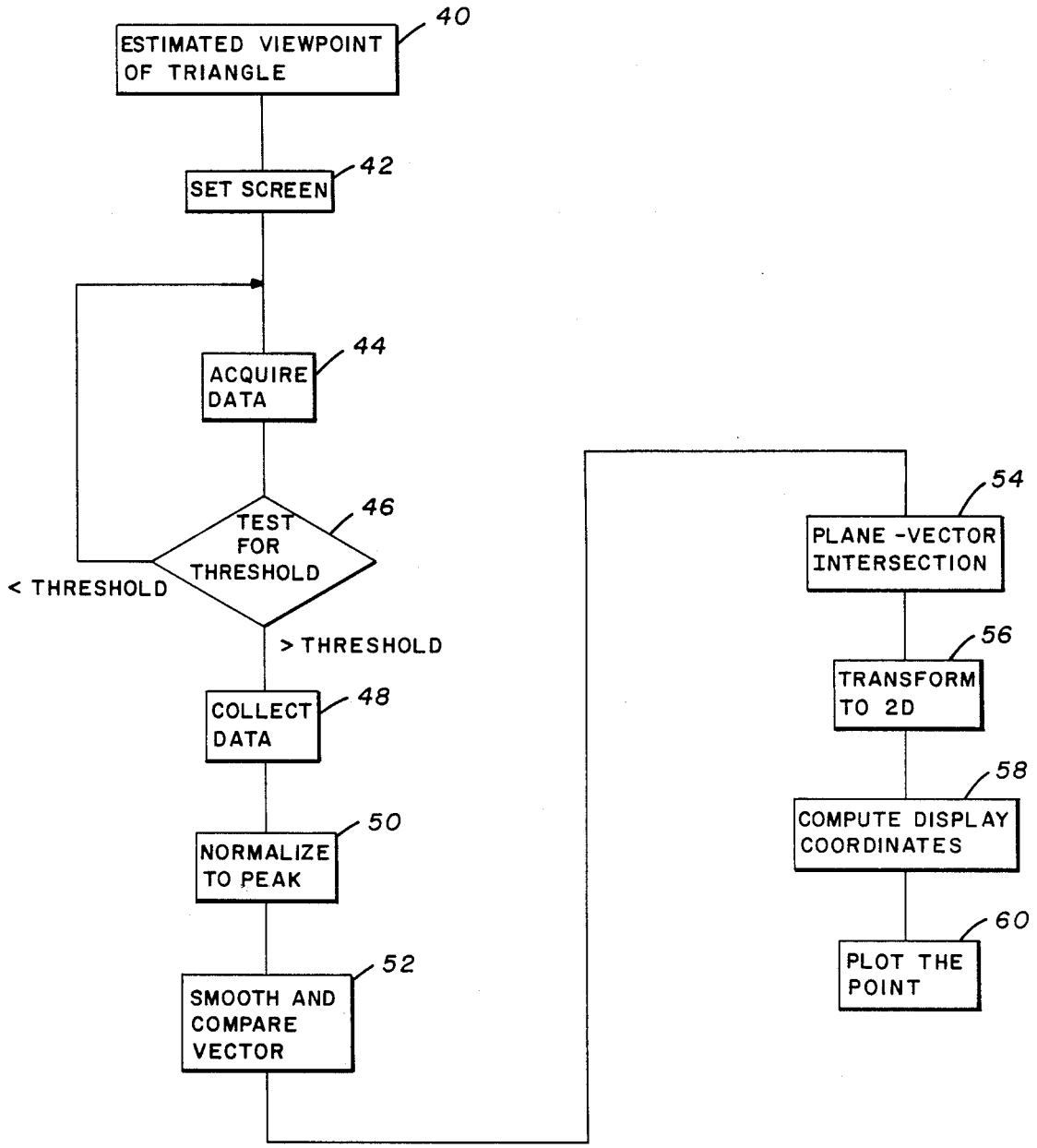

FIG. 4 shows the transformation of the tri-coordinate system and the pierce point of the ranking vector of FIG. 3. The resulting transformation comprises a triangle 36, the apexes of which correspond to the low, mid, and high frequency bands. A point within this triangle defines the relative amplitude of the three coordinates of the ranking vector 34. Vowels can be identified on the basis of the relative amplitude of the energy in the three bands, thus the location of a point within FIG. 4 serves to identify the vowel being uttered during the time intervals which produced the ranking vector. FIG. 4 illustrates the locations within the triangle appropriate to five vowels. The vowel /u/ (as in boot) has its greatest energy in the low band and the least energy in the high band, with the mid band energy between them.

FIG. 5 shows the flowchart for the software program 62 which generates the Ranking Diagram of FIG. 4. Accordingly, a desired viewpoint of the resultant triangle is established initially. At step 42 the screen is set, cleared, and labeled. A data sample is acquired at 44, which is then tested for its threshold level in the voicing band. If the test for a threshold is unsuccessful at 46, that is the threshold level is not obtained, another data sample is acquired at 44. However, if the threshold is greater than a predetermined level, a group of data samples, 50 for instance, is collected at 48 into memory. The collected data representing the low, mid, and high bands, is then normalized about the peak band at 50. The resultant information is smoothed by an RMS calculation and a three-coordinate vector is computed at 52. The intersection of the resultant vector and the triangular plane 32 (see FIG. 3) is then calculated at 54. At 56, the three-dimensional image is transformed into a two-dimensional image, revealing a triangle 36 of FIG. 4. The display coordinates are then computed at 58 and the resultant point is plotted at step 60.

Modifications are apparent to one skilled in the appropriate art, the scope of the invention being defined by the appended claims.

What is claimed is:

1. A speech waveform analyzer comprising:

an input device for generating an alternating current (AC) signal representative of a phoneme received by the input device;

a plurality of filters connected to the input device for dividing the AC signal into corresponding frequency band signals;

a converting means connected to each of the plurality of filters for converting the amplitude of the energy in each of said frequency band signals to direct current (DC) voltage levels;

an acquiring means connected to the converting means for acquiring and converting to digital values said DC voltage levels and for temporarily storing in said acquiring means a set of digital values representative of each DC voltage level produced by said converting means;

processing means connected to said acquiring means for processing said digital values wherein said processing means comprises:

a threshold means which receives a digital value from said acquiring means for testing whether said digital value exceeds a predetermined threshold thereby indicating the presence of a spoken phoneme, a collecting means for collecting and for temporarily storing, in response to an indication of the presence of a spoken phoneme from said threshold means, said set of digital values acquired and stored by said acquiring means, means for generating a tri-coordinate system comprising three axes and an origin, and a piercing plane which intersects each axis equidistant from said tri-coordinate system origin, and a computing means, for using said set of digital values received from said collecting means for plotting a pierce point in said tricoordinate system, and for computing a representation of said phoneme, wherein said computing means comprises:

a selecting means for selecting a set of three values from said set of digital values representing said frequency band signal energy amplitudes, a vector computing means for computing a vector in said tri-coordinate system, said vector defined by said tri-coordinate system origin and a point whose coordinates are determined by said set of three values representing said frequency band signal energy amplitudes of said AC signal, wherein each of said values in said set of three values defines a distance from said tricoordinate origin along one of said tricoordinate axes, and a plotting means for plotting said pierce point where said vector pierces said piercing plane of said tri-coordinate system; and a display device, connected to said processing means, for visually presenting said computed representation.

2. A speech waveform analyzer as in claim 1, said computing means further including a transforming means for transforming said tri-coordinate system and said pierce point of said vector into a two-dimensional representation.

3. A speech waveform analyzer as in claim 2, said two-dimensional representation comprising a triangle and a point positioned therein, wherein the relative position of said point in said triangle provides a visual representation of the phoneme received by the input device when displayed on a display device.

4. A speech waveform analyzer as in claim 3, said computing means further including normalizing means for normalizing said set of three values derived from said frequency band signal amplitudes about the value representing the occurring peak amplitude before computing said vector.

5. A speech waveform analyzer as in claim 4, further comprising a shape filter connected between said input device and said plurality of filters.

6. A speech waveform analyzer as in claim 5, wherein one of said plurality of filters comprises a voicing filter dividing the AC signal into a voicing band signal.

7. A speech waveform analyzer as in claim 6, wherein said plurality of filters further comprises first, second, and third additional filters further dividing the AC signal into first, second, and third frequency band signals, respectively.

8. A speech waveform analyzer as in claim 7, said voicing and first, second, and third additional filters comprising switched capacitor filters.

9. A speech waveform analyzer as in claim 8, the converting means comprising a Root-Mean-Square (RMS) converter circuit.

10. A speech waveform analyzer as in claim 9, the RMS converter circuit comprising four RMS converters, each of which is correspondingly connected to the voicing, first, second, and third filters.

11. A speech waveform analyzer as in claim 10, the acquiring means comprising a data acquisition system.

12. A speech waveform analyzer as in claim 11, the acquiring means further comprising a Random Access Memory (RAM).

13. A speech waveform analyzer as in claim 12, including a clocking means connected to clock DC voltage levels into the acquiring means.

14. A speech waveform analyzer as in claim 1, further comprising a shape filter connected between said input device and said plurality of filters.

15. A speech waveform analyzer as in claim 14, wherein one of said plurality of filters comprises a voicing filter dividing the AC signal into a voicing band signal.

16. A speech waveform analyzer as in claim 15, the converting means comprising a Root-Mean-Square (RMS) converter circuit.

17. A speech waveform analyzer as in claim 16, the acquiring means comprising a data acquisition system.

18. A speech waveform analyzer as in claim 17, the acquiring means further comprising a Random Access Memory (RAM).

19. A speech waveform analyzer as in claim 18, including a clocking means connected to clock DC voltage levels into the acquiring means.

20. A speech waveform analyzer as in claim 19, the display device generating a triangle and a point positioned therein, wherein the relative position of said point in said triangle provides a visual representation of the phoneme received by the input device.

21. A method for generating a visual representation of a spoken phoneme comprising the steps of:

a. dividing a speech waveform generated by said spoken phoneme into a plurality of frequency band signals;

b. determining the amplitude of the energy in each frequency band signal of said plurality of frequency band signals;

c. generating a tri-coordinate system with three axes and an origin, and a piercing plane which intersects each axis equidistant from said tri-coordinate system origin;

d. selecting a set of three values from said frequency band signal energy amplitudes;

e. computing a vector in said tri-coordinate system, said vector defined by said tri-coordinate system origin and a point whose coordinates are determined by said set of three values derived from said frequency band signal energy amplitudes, wherein each of said values in said set of three values defines a distance from said tricoordinate origin along one of said tri-coordinate axes; and f. plotting a pierce point where said vector pierces said piercing plane of said tri-coordinate system wherein the relative position of said pierce point in said piercing plane provides a visual representation of said spoken phoneme.

22. A method for generating a visual representation of a spoken phoneme as recited in claim 21, further comprising the step of:

g. transforming said tri-coordinate system and said pierce point of said vector into a two-dimensional representation comprising a point within a triangle wherein the relative position of said point in said triangle provides a visual representation of said spoken phoneme.

23. A method for generating a visual representation of a spoken phoneme as recited in claim 22, further comprising the step of:

h. normalizing said set of three values selected from said frequency band signal amplitudes about the value representing the occurring peak amplitude before computing said vector.

* * * * *